US007520238B2

(12) United States Patent
Patterson

(10) Patent No.: US 7,520,238 B2
(45) Date of Patent: Apr. 21, 2009

(54) BOAT STABILIZER

(76) Inventor: Robert Michael Patterson, 2907 Shelter Island Dr., Suite 105, PMB 170, San Diego, CA (US) 92106

( * ) Notice: Subject to any disclaimer, the term of this patent is extended or adjusted under 35 U.S.C. 154(b) by 0 days.

(21) Appl. No.: 11/526,346

(22) Filed: Sep. 25, 2006

(65) Prior Publication Data

US 2008/0072811 A1 Mar. 27, 2008

(51) Int. Cl.
*B63B 1/24* (2006.01)

(52) U.S. Cl. ..... 114/274; 114/278

(58) Field of Classification Search ..... 114/274
See application file for complete search history.

(56) References Cited

U.S. PATENT DOCUMENTS 3,137,260 A * 6/1964 Harris, Jr. et al. ..... 114/275
3,704,442 A * 11/1972 Wright ..... 367/96
3,742,890 A 7/1973 Hubbard et al.
3,955,527 A 5/1976 Holtermann
3,980,035 A 9/1976 Johansson
4,487,152 A 12/1984 Larson
4,708,672 A 11/1987 Bentz
4,811,674 A 3/1989 Stewart
4,968,275 A 11/1990 Carlson
4,995,840 A 2/1991 Seale
5,048,449 A 9/1991 Templeman
5,144,904 A 9/1992 Weldon
5,168,824 A 12/1992 Ketterman
5,638,765 A * 6/1997 Poulos ..... 114/274
5,673,641 A 10/1997 Sournat et al.
5,819,678 A 10/1998 Austin
5,848,922 A 12/1998 Itima
5,860,384 A * 1/1999 Castillo ..... 114/280
6,019,059 A 2/2000 Kelsey
6,889,623 B2 5/2005 Ferrari
6,925,953 B1 8/2005 Batista et al.
6,973,847 B2 12/2005 Adams

OTHER PUBLICATIONS

KOOPNAUTIC, koopnautic website, 2006.
Maritime Dynamics, Inc., "Making Passengers Comfortable", First Published by Incat The Magazine vol. 2, Issue 4, 5, and 6, May 1, 2001, 6 pages.

* cited by examiner

*Primary Examiner*—Jesus D Sotelo
(74) *Attorney, Agent, or Firm*—J. Curtis Edmondson

(57) ABSTRACT

A vessel hull stabilization system is presented that uses hydrofoils mounted on the vessel. The hydrofoils create a counteracting force to the waves that would otherwise cause the vessel to roll and pitch. The hydrofoil is connected to the vessel in both passive and an active modes. The hydrofoil consists of a number of configurations that include a number of attached struts and foils which provide additional counteracting forces in response to wave action.

4 Claims, 14 Drawing Sheets

BOAT STABILIZER

BACKGROUND OF THE INVENTION

1. Field of the Invention

The present invention relates to a device for stabilizing boats, in particular yachts.

2. Discussion of the Related Art

Boats in general and yachts in particular are subject to the force of wind and waves. These wave actions cause a boat to roll, pitch and yaw in an unpleasant manner. This creates an unpleasant sensation for a person who does not spend a significant time on a boat. The sensation may be so extreme as to cause a condition known as seasickness. These unpleasant forces effect the yacht and passengers at all times, underway and at rest.

Boat movement, relative to its level position, is measured in terms of pitch (movement along the axis line from bow to the stern), roll (movement along the axis line from the port side to the starboard side), and yaw (a rotational heading movement along the center point of the boat).

There are a number of ways to reduce vessel movement. A solution is to build a larger vessel, which is usually not an economical solution in most cases. Another approach is to only use the vessel during calm seas, although this is impractical for vessels that must be used on a daily, commercial basis.

Active control systems have been developed to reduce the problem of vessel roll only. One such device is disclosed in U.S. Pat. No. 4,487,152 to Larson which illustrates the use of an air foil-shaped stabilizer above the propeller to induce a lift at the stern portion of the boat.

An attitude control device in the form of a wing or vane is also disclosed in U.S. Pat. No. 3,980,035 to Johansson which shows the vane positioned in the slip stream behind the propeller.

Other developments involve forming the anti-cavitation plate with an inclined lower surface to preclude formation of low pressure areas into which air or exhaust gases can be sucked, and to exert a lift at the stern of the boat. A deflector has also been developed to create a high pressure area at the trailing edge of the anti-cavitation plate to improve trim tab effectiveness by forestalling the passage of air into the area of the trim tab, such as the device disclosed by Holterman in U.S. Pat. No. 3,955,527.

U.S. Pat. No. 4,708,672 to Bentz a boat stabilization systems uses an adjustable wedge-shaped member formed on an adjustably mounted trim tab located on the underside of an anti-cavitation plate of an outboard motor. The wedge-shaped member tends to have a downwardly inclined lower surface extending generally laterally from and perpendicularly to a fin-shaped member of the trim tab. Movement of the boat through the water imparts a force against the downwardly inclined surface to effect a generally vertical torque on the boat substantially eliminating proposing of the boat in a given speed range.

U.S. Pat. No. 4,968,275 to Carlson a stabilizer is attached to the cavitation plate on the leg of a motor boat motor. Two elongated tubular members are attached by mounting brackets to the motor's cavitation plate. The tubular members are attached at a downward angle away from the boat so that an upward force is created by the hydrodynamic jet action of water flowing through the tubular members at the rear of the boat when the boat moves in a forward direction. The upward jet created force at the rear of the boat keeps the boat horizontal and stable at high speeds.

U.S. Pat. No. 4,995,840 to Seale, et al the describes a stabilizing fin for a motor boat which is of a generally triangular shape, and the fin is attached to the mounting side with a longitudinally extending slot for mounting on a cavitation plate on a motor post of an outboard motor. Suitable means are also provided for removably securing the fin to the cavitation plate.

U.S. Pat. No. 5,048,449 to Templeman describes a stabilizing system that has the first and second arm portions that are removably attached. The first and second arms together and selectively movable toward and away from each other for varying the width of the slot. The ability to vary the width of the slot for receiving the drive unit allows the stabilizer to be adjusted to fit virtually any conventional outboard or inboard/outboard boat motor.

U.S. Pat. No. 5,144,904 to Weldon describes a stabilization system when the boat was not in motion. The apparatus for stabilizing boats is comprised of a weighted concave body which is suspended from the boat and which is formed as a grid defining openings through the body and a flexible flap in the concavity of the body, the flap blocking the openings when the body rises in the water due to rolling of the boat so as to inhibit rolling and the flap moving away from the openings to permit the apparatus to rapidly fall as the boat rolls in the opposite direction.

U.S. Pat. No. 5,848,922 to Itima, et al. describes a stabilization system that attaches above the propeller. It is a hydrofoil stabilizer for a marine motor that includes a hydrofoil wing having a generally planar configuration and a shroud member affixed to an underside of the hydrofoil wing.

U.S. Pat. No. 6,973,847 to Adams uses a gyroscopic roll stabilizer for control of the boat. The stabilizer includes a flywheel, a flywheel drive motor configured to spin the flywheel about a spin axis, an enclosure surrounding a portion or all of the flywheel and maintaining a below-ambient pressure or containing a below-ambient density gas, a gimbal structure configured to permit flywheel precession about a gimbal axis, and a device for applying a torque to the flywheel about the gimbal axis. The flywheel, enclosure, and gimbal structure are configured so that when installed in the boat the stabilizer damps roll motion of the boat. Preferably, the flywheel drive motor spins the flywheel at high tip speeds.

Commercially available stabilizers with varied designs are manufactured by Koopnautic (www.koopnautic.com)

SUMMARY OF THE INVENTION

The present invention provides a way to reduce vessel roll, pitch and yaw motions to provide a more comfortable seagoing experience while the vessel is moving forward at any speed. Additionally the system controls vessel roll at rest.

The system operates in both passive and active mode.

In passive mode, the preferred embodiment consists of a hydrofoil attached to the transom of the vessel. The hydrofoil has NACA shaped foil members that create lift forces to counteract forces created against the boat by the waves. These counteracting forces reduce the unwanted movement of the boat, thus leading to stabilization. A jack screw maintains the hydrofoil at the most effective fixed angle of the attack.

In active mode, a motion measuring transducer is mounted to the vessel and connected to a computer controlled hydraulic system. When the motion sensor transducer detects movement, the hydraulic actuator—coupled to the hydrofoil—moves the hydrofoil to create a counteracting force that reduces the movement of the boat, leading to stabilization.

A number of embodiments of the hydrofoil are presented that provide vessel stabilization.

BRIEF DESCRIPTION OF THE DRAWINGS

Taking the following specifications in conjunction with the accompanying drawings will cause the invention to be better understood regarding these and other features and advantages. The specifications reference the annexed drawings wherein.

DETAILED DESCRIPTION

While describing the invention and its embodiments various terms will be used for the sake of clarity. These terms are intended to not only include the recited embodiments, but also all equivalents that perform substantially the same function, in substantially the same manner to achieve the same result.

Figure 1:
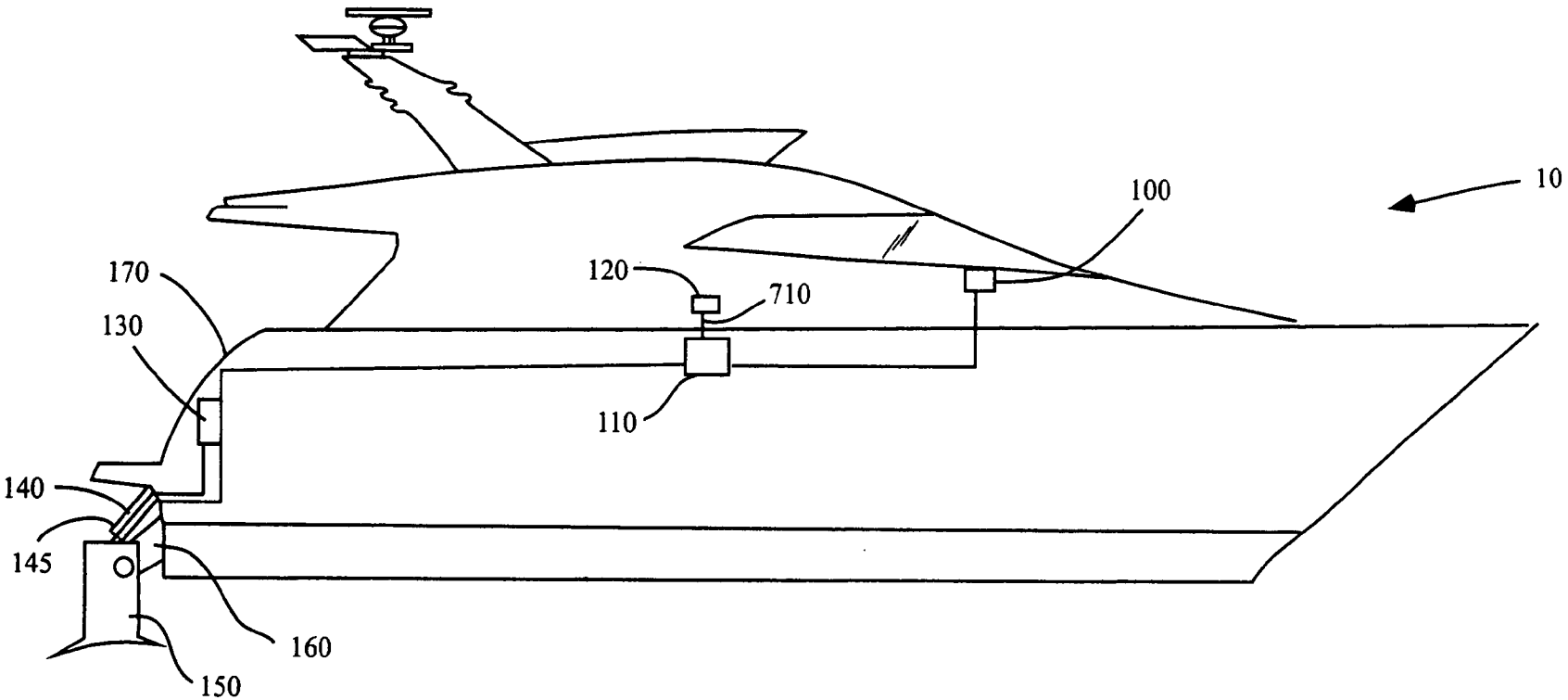
FIG. 1 is systems diagram of the complete active stabilization system as mounted in the vessel; and includes system electrical and hydraulic components as located on the vessel.

As shown in FIG. 1, a schematic diagram of a vessel 10 provides a view of the components of the hydraulic control system used to actively reduce roll of the boat underway or roll at rest. Optionally, the computer control system may be configured to actively control and reduce pitch motion. Each of the two hydrofoils requires a corresponding system of an associated hydraulic control valve and hydraulic actuator for active mode.

The operator control 100 is electrically connected to an active control computer 110. The active control computer 110 is electrically connected to a motion sensor 120. The active control computer system 110 is electrically connected to a hydraulic control valve 130. For each hydrofoil the hydraulic control valve 130 is hydraulically connected to a hydraulic cylinder actuator 140, utilizing hydraulic hoses. The hydraulic cylinder actuator 140 is mechanically connected to the hydrofoil 150. The hydrofoil 150 is mechanically connected to a hull bracket 160, which is attached mechanically to the hull transom 170 of the vessel 10. The hydrofoil position-sensor 145 is mechanically connected to hydrofoil 150 and or the actuator 140. The hydrofoil position-sensor 145 is electrically connected to the active control computer 110 for position feed back.

Figure 2:
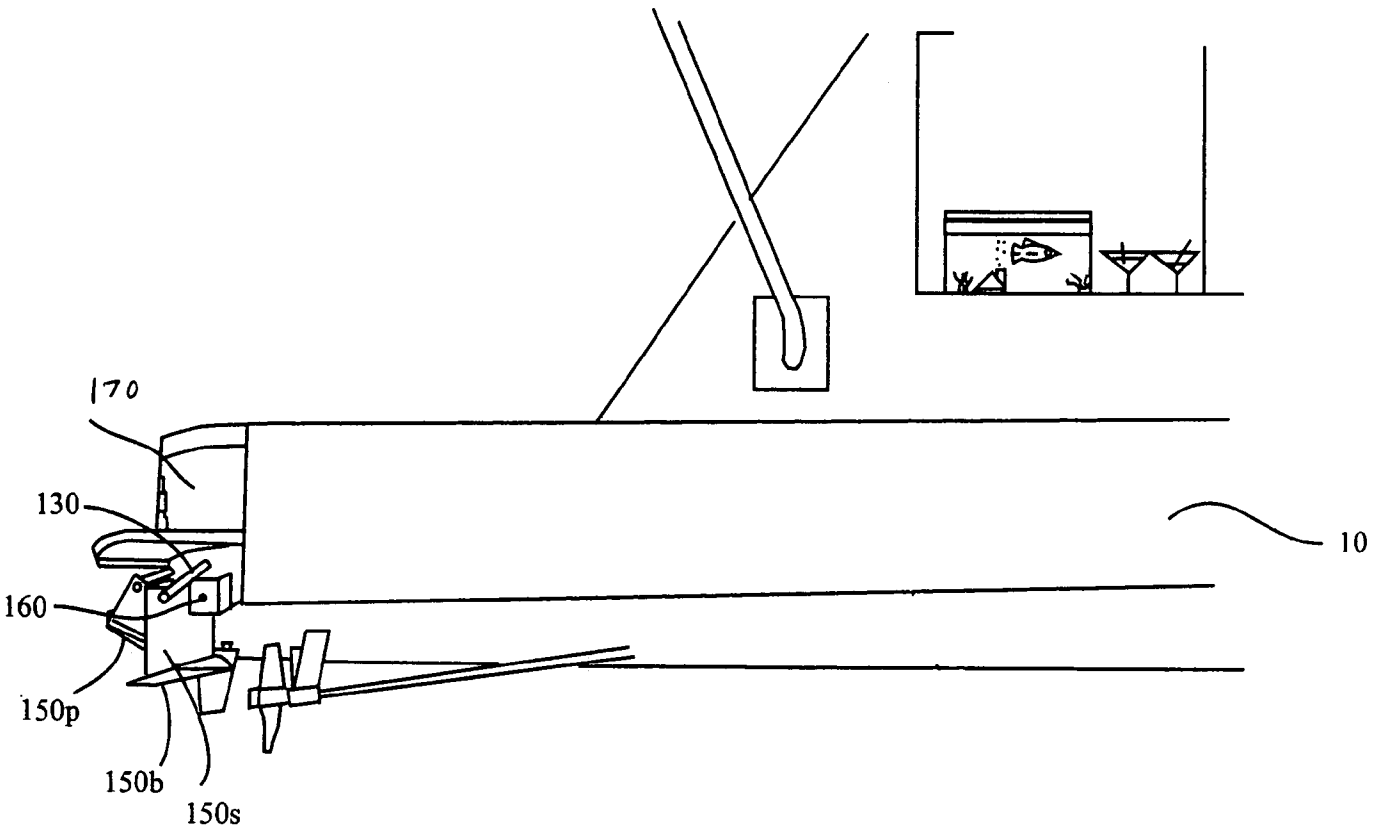
FIG. 2 is a close up view of the passive stabilization system as mounted to the stern of the vessel.

As shown in FIG. 2 a schematic diagram of a vessel 10 provides a view of the components of the system used to passively reduce the roll, pitch and yaw of the boat underway only. FIG. 2 shows a close view of the hull transom 170 of the vessel 10 where the hydrofoils 150*p* (port) and 150*s* (starboard) are mounted to the hull bracket 160 in passive mode configuration. A positioning jackscrew 130 replaces the active hydraulic actuator 140.

Multiple Embodiments of the Boat Stabilizer

A multitude of hydrofoils are available to be mounted on the transom of the vessel. FIGS. 3,4,5,6 show alternate detailed embodiments of the boat stabilizers using the hydrofoils.

Figure 3:
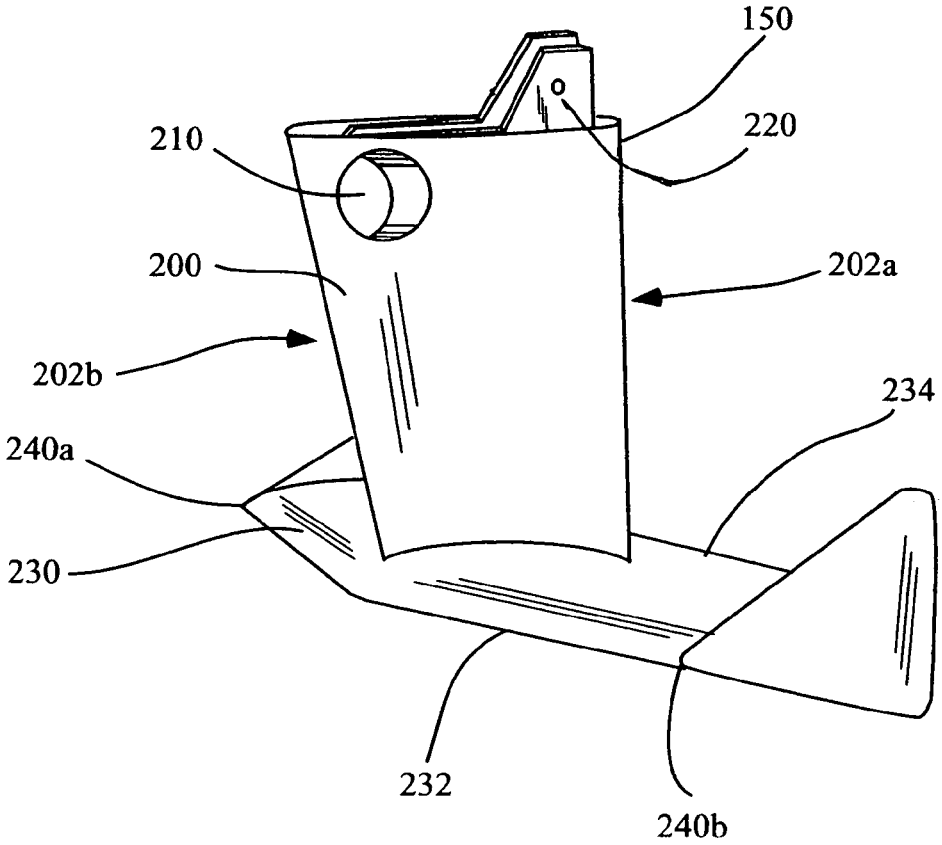
FIG. 3 is a side view of one stabilization hydrofoil with winglets.

FIG. 3 Single Foil Embodiment

Now referring to FIG. 3 is a close up view of one embodiment of the hydrofoil 150. The vertical NACA foil 200 is constructed to have a rounded leading edge, 202*b*. The leading edge 202*b* at the front tapers to a trailing edge 202*a* at the rear. As the boat moves forward, the vertical NACA foil 200 passes through the water. The NACA shape passively generates the force of lift in one direction. This lift force is directed outboard on each side of the vessel to passively reduce roll and yaw. This also allows for a greater turning rate at certain cruising speeds.

The effect of the NACA shape allows for minimal drag associated with generating lift, and limits drag associated with the resistance of an object moving through water This lift force dampens uncomfortable roll and yaw since the boat must overcome this opposing lift force, to move out of a straight and level position related to the earth's horizon and compass heading.

The minimization of the roll and yaw is also dependent on the mounted angle of the vertical foil 200, which is manually adjusted by the installer.

Horizontal NACA Foil

Still referring to FIG. 3. Attached on the bottom and perpendicular to the vertical foil 200 is a NACA shaped horizontal foil 230. The foil is rounded at the front leading edge 232 of the foil and tapers to a blunt point on the rear trailing edge section 234 of the foil.

The horizontal foil 230 is bent at the center. The bend line begins at the leading edge, at the center point, just forward of the leading edge of the vertical foil 200, and continues to the point where the vertical foil trailing edge 202*a* terminates. Then it continues to the trailing edge 234 at center. The bend is approximately 10 degrees and serves four purposes:

1) Serves to increase the design strength of the horizontal foil.
2) Provides a cupping component for use as a low to zero speed roll stabilizer.
3) Allows the installation technician to make directional control adjustments for the direction of upward lift.
4) Allows for greater clearance between the hull bottom and clear water flow, from the effect of disturbed water flow emanating from the hull bottom, trim tabs and fittings.

Mounted on, and perpendicular to the ends of the horizontal foil 230 are two optional winglet foils 240*a* and 240*b*. As depicted, these winglet foils have a modified triangular shape, but, they may be configured in a multitude of dimensions or not used at all, in favor of a rounded or squared off wing tip. The winglets increase lift and decrease drag. Second, the winglets aid in retaining water in a cupping action for use as a zero to low speed roll stabilizer. The winglet dimension above 230 is reduced for maximum effectiveness as a stabilizer at rest, so water may more efficiently flow off the top of the horizontal foil 230.

Passive Design Effect

The total hydrofoil 150 design prevents uncomfortable boat movement in passive mode, without the need for hydraulic actuation. This makes this design a cost effective solution for boat owners. Other competitive systems require hydraulic actuation to overcome uncomfortable boat motion.

Passive stabilization occurs when the hydrofoil is attached to the hull and placed at a fixed angle of attack. The design configuration of the hydrofoil is effective enough to dampen vessel pitch, roll, and yaw without the need for hydraulic actuation.

Active stabilization uses the hydraulic actuator and computer control system as previously shown in FIG. 1. Active stabilization provides for additional roll or pitch control by altering the angle of attack of the horizontal foil 230. Based on the vessel motion sensor information provided to the onboard computer, control hydraulics will increase or decrease the lift force generated by the horizontal foil 230. Active stabilization ads roll dampening effectiveness produced by the horizontal foil. Active stabilization also allows for roll or pitch stabilization at low to zero forward motion of the vessel. Active stabilization also allows for vessel attitude trim adjustments (e.g. when vessel loading affects the heel or pitch of the boat).

As shown in FIG. 3, for active stabilization the hydraulic cylinder actuator 140 (FIG. 1) is connected to the vertical NACA foil 200 using the hydrofoil's actuator mounting hole 220 located at the torque plates above the upper trailing edge of the vertical foil 200. The vertical NACA foil 200 is connected to the transom of the boat at the hydrofoil-bracket mounting hole 210 utilizing a bearing assembly inserted in hole 210.

Multiple Element Foil Embodiments

Figure 4:
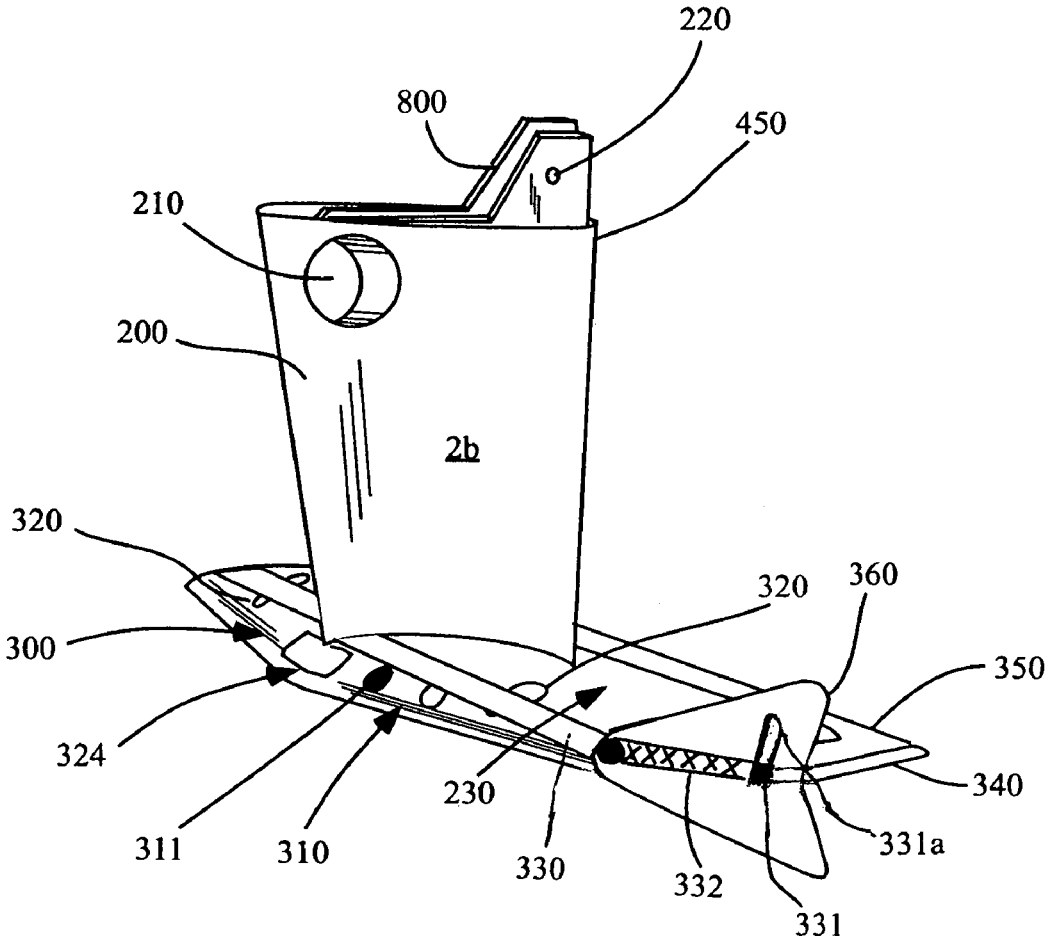
FIG. 4 is a side view of an alternate embodiment of the stabilization hydrofoil with a split flap element shown in the down position.

Now referring to FIG. 4. FIG. 4 demonstrates a close up view of a second embodiment of the hydrofoil 450.

The hydrofoil 450 is configured in the same manner as shown in FIG. 3. A split flap 350 is connected to the horizontal NACA foil 230. The split flap 350 is connected via tie rods 330, pivot arms 332, and mounts 320.

A pivot arm 332 is connected to the split flap 350 on each side. The pivot arm 332 exists to change the position of the flap. A flexible joint 331 with stops is used to allow for the proper angle to maintain the split flap 350 in a neutral position, at high boat speed.

During periods of high boat speed operation, an automatic computer controlled system (as depicted in FIG. 1) pulls the split flap 350 down. This decreases the lift generated by the foil and flap assembly.

Computer controlled actuation moves this split flap 350 into position as directed automatically utilizing a position feed back sensor 311 and hydraulic, pneumatic or electric actuation.

Optionally the split flap 350 is adjusted to an effective position by mechanical means. Mechanical actuation moves this split flap 350 into an effective position as directed manually by the operator utilizing a position feed back sensor 311 reading as a reference.

A limit stop 310 prevents the tie rod member from rotating past a desired set point. This set point is adjustable via an externally accessible set screw device. In addition to providing the result described above, the split flap operates differently when the stabilizer 450 is controlling motion while the boat is at rest or at low speed.

This split flap 350 is used to increase and decrease cupping action at low to zero speed operation. Cupping action is increased when the horizontal foil moves in its downward stroke and cupping action is decreased in its upward stroke, since the flap falls away. This cupping action is similar to a swimmer using cupped hands to maintain body orientation while treading water.

During active stabilization at low to zero speed, one horizontal foil is directed downward on the side of the boat that is rolling away from upright attitude. At the same time, the foil on the other side of the boat is moving up. The split flap 350 separates and moves downward to decreases cupping action, so water spills out freely.

Figure 4A:
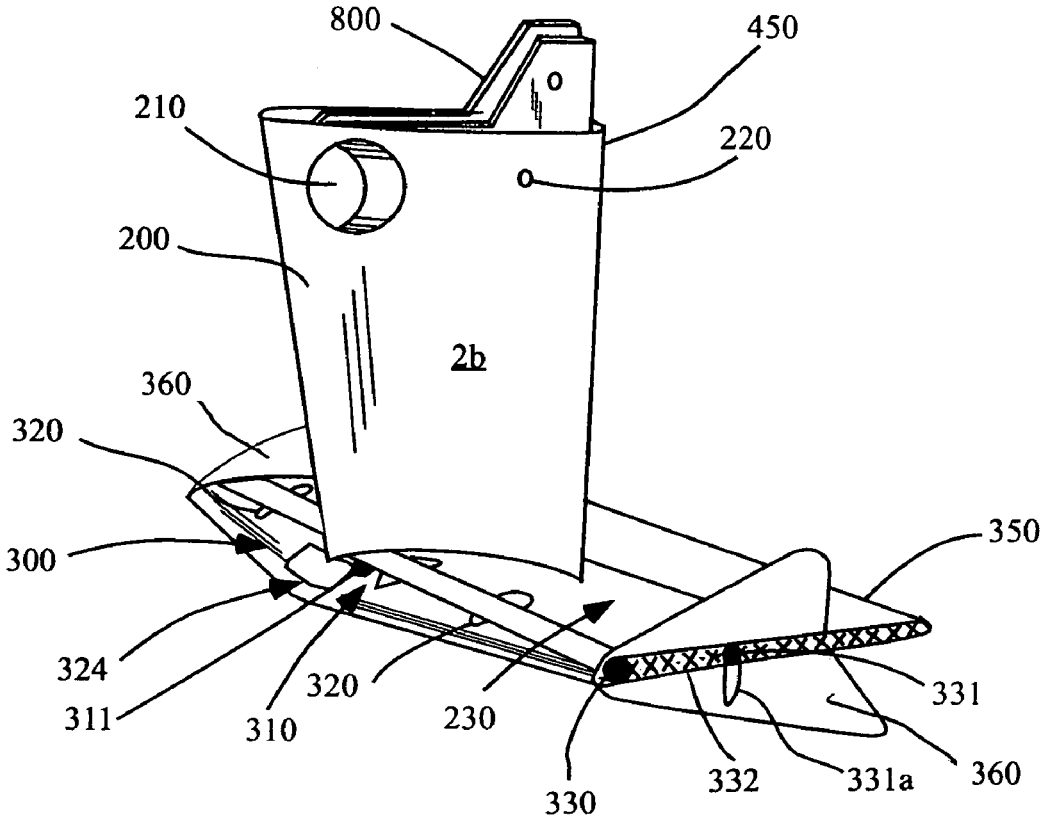
FIG. 4A shows a fairing guide, with the split flap is in the up position.
Figure 4B:
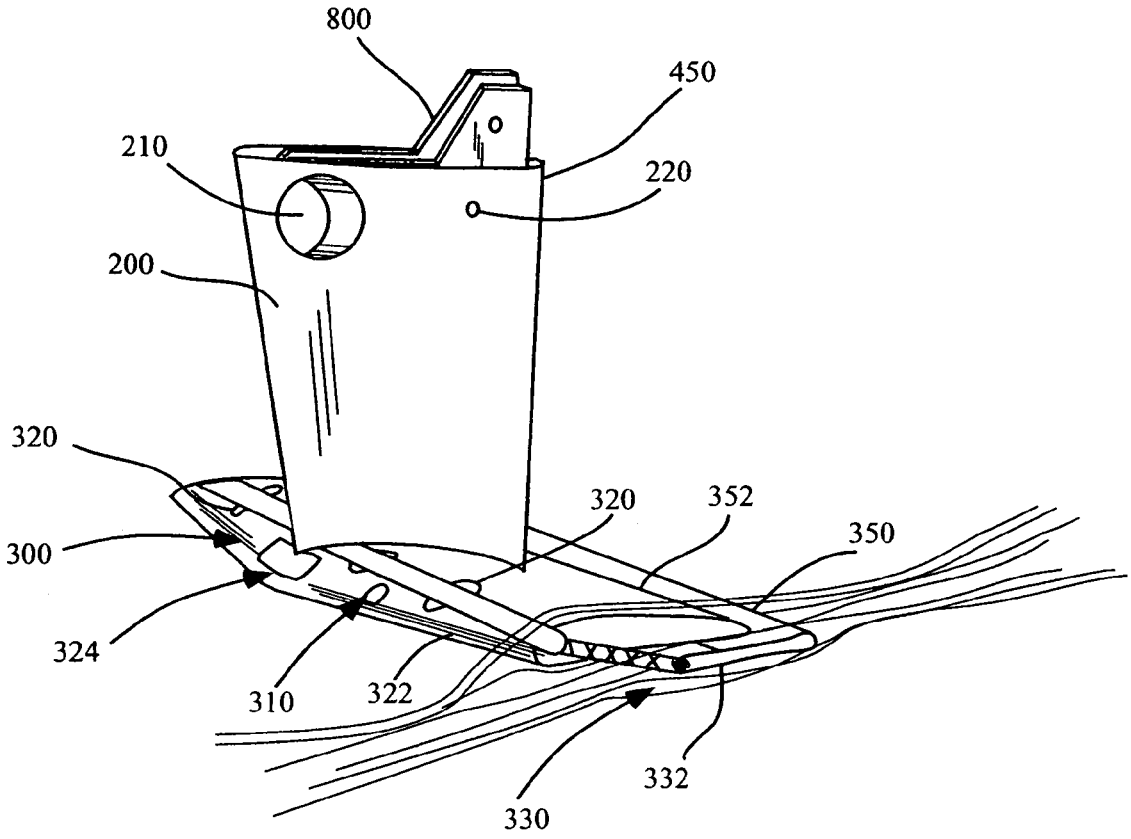
FIG. 4B shows the split flap in the down position with lines indicating the flow of water.

Now referring to FIG. 4A the split flap 350 is shown in the full up and nested position. FIG. 4A shows a winglet fairing guide 360 which provides a track guide 331*a* for the roller pin 331 to guide and support the pivot arm assembly 332. The winglet fairing guide 360 also provides for protection and decreased parasite drag from the arm 332 and other components. FIG. 4B depicts water flowing through the split flap.

Figure 5:
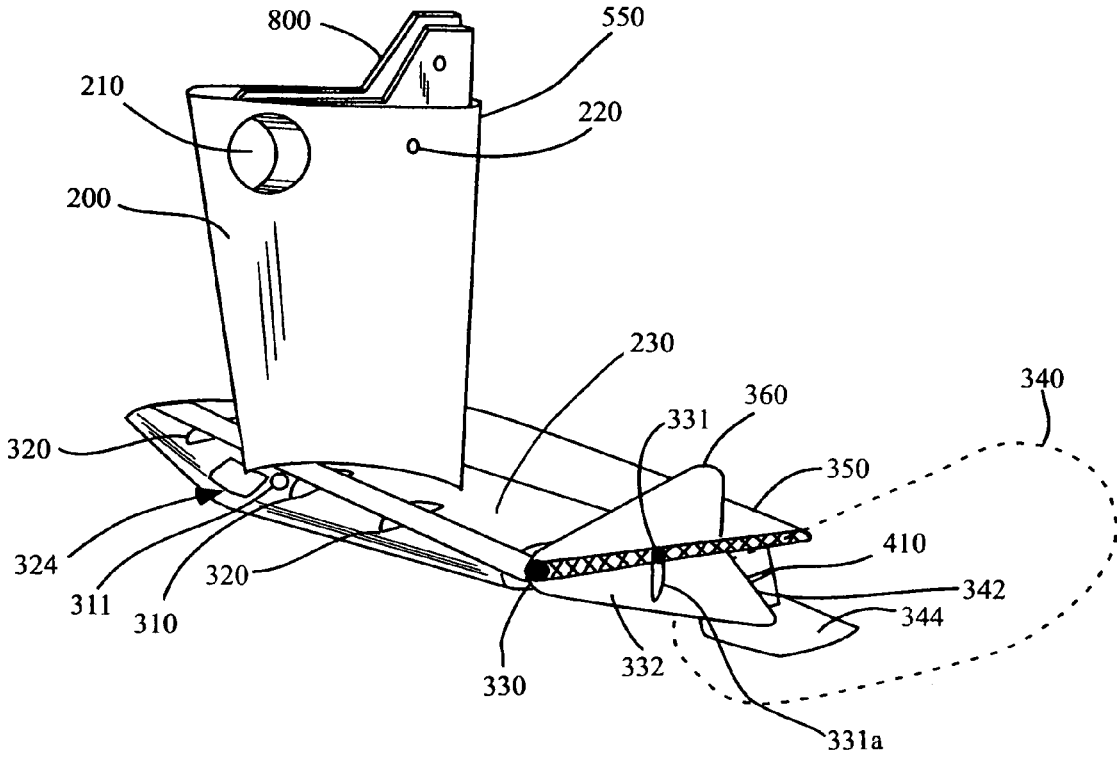
FIG. 5 is a side view of a third alternate embodiment of the stabilization hydrofoil; with the addition of the pull-down mini foil device shown in the up position.

Now referring to FIG. 5, which is a close up view of a third embodiment of the hydrofoil 550.

The hydrofoil 550 works both passively and or actively with hydraulic control. A second rigid member assembly 340 is added and connected to the split flap 350. The second rigid member assembly 340 has a mini foil 344 connected to a lower strut 342, which is connected to the split flap 350.

During periods of high speed operation, the force of the flowing water pulls the split flap 350 down, utilizing the lift force in the downward direction produced by the mini foil 344. This decreases the lift generated by the foil 230 and flap assembly 350, since there is less surface area on 230 to generate lift.

This mini-foil 344 is composed of a lower NACA section. The mini-foil 344 is connected by a lower strut 342 to the split flap 350. An adjustment 410 is provided to set the lower NACA foil 340 at an angle of attack which will pull the split flap 350 down at a desired speed.

In automatic operation, the NACA foil 344 generates a downward lift force which automatically pulls the split flap away from the horizontal foil 230 at a moment when pressure on the flap is reduced during hydraulic actuation. Additional mini foil assemblies may be added to the split flap 350 end or mid section if needed.

Figure 5A:
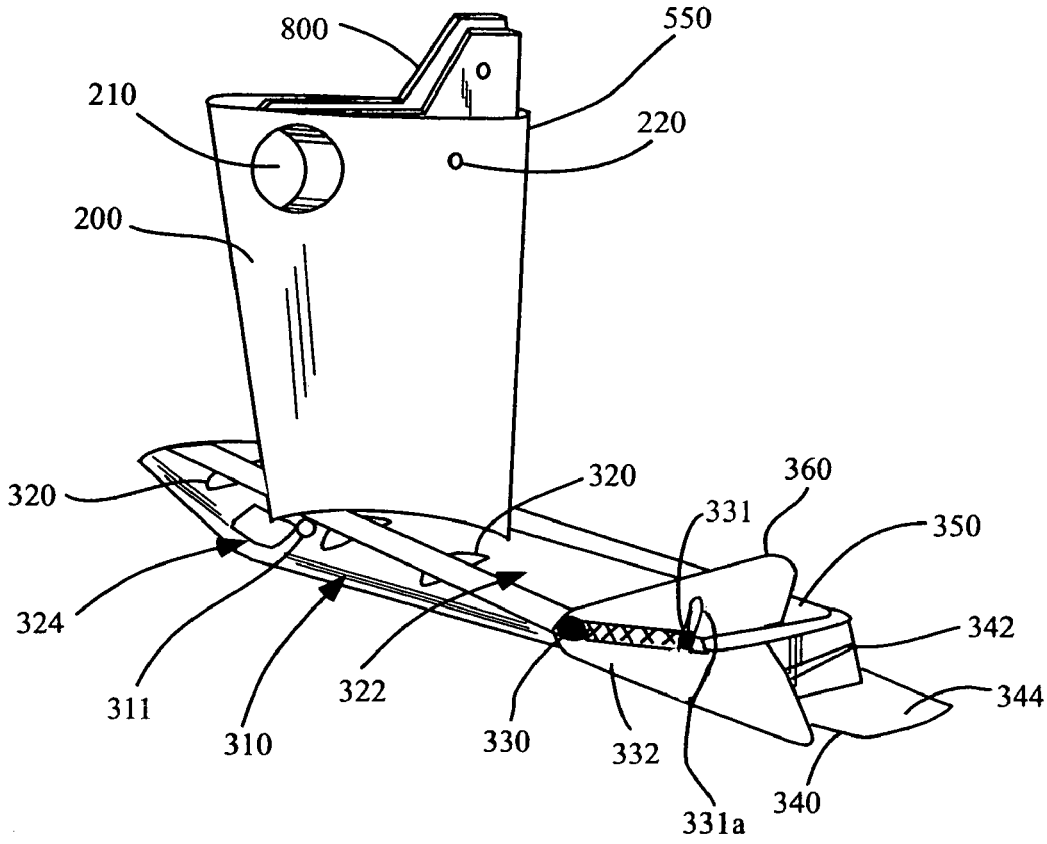
FIG. 5A is a side view of a third alternate embodiment of the stabilization hydrofoil; with the addition of the pull-down mini foil device shown in the down position.

FIG. 5A shows the split flap in the pulled down configuration.

Both FIGS. 5 and 5*a* shows a winglet fairing guide 360 which provides a track guide 331*a* for the roller pin 331 to guide and support the pivot arm assembly 332

The fairing guide 360 also provides for protection and decreased parasitic drag from the arm 332.

Figure 5B:
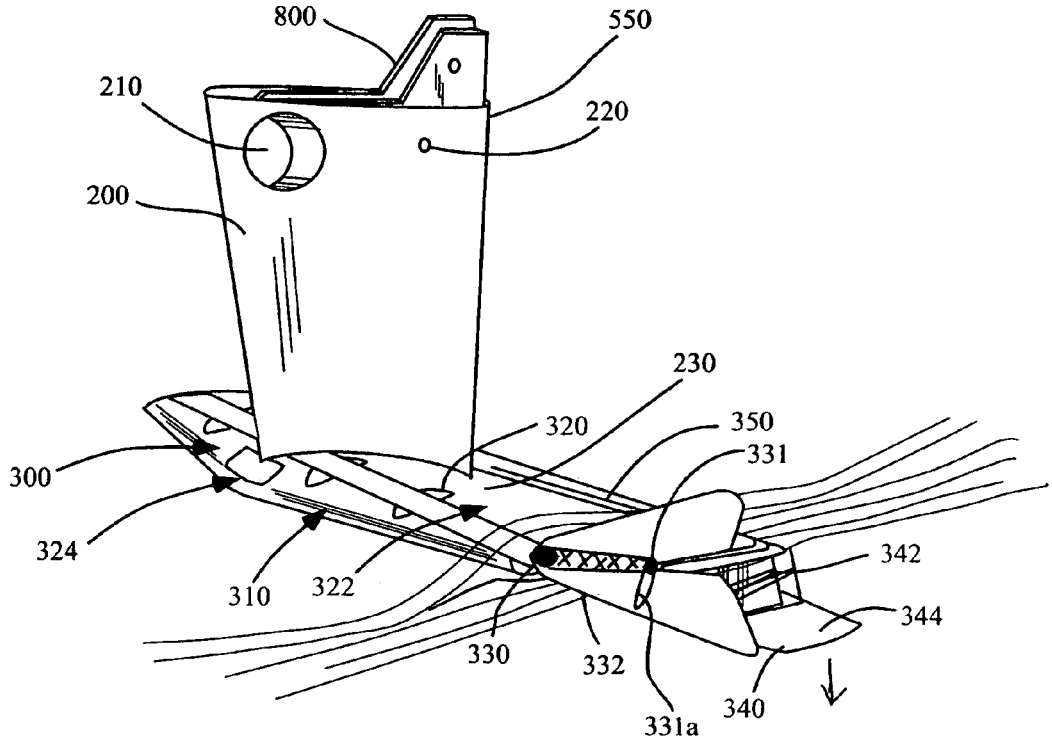
FIG. 5B is a side view of a third alternate embodiment of the stabilization hydrofoil; with the addition of the pull-down mini foil device shown in the down position with lines indicating the flow of water.

FIG. 5*b* shows the flow of water between the Horizontal Foil 230 and the split flap. An arrow shows the direction of lift generated by the mini foil 344. In this configuration the split flap 350 is producing zero lift and is trailing (ultra low drag). When the split flap 350 is producing zero lift forces, the mini foil 344 is able to hold the split flap 350 down.

Alternate Foil Embodiment

Figure 6:
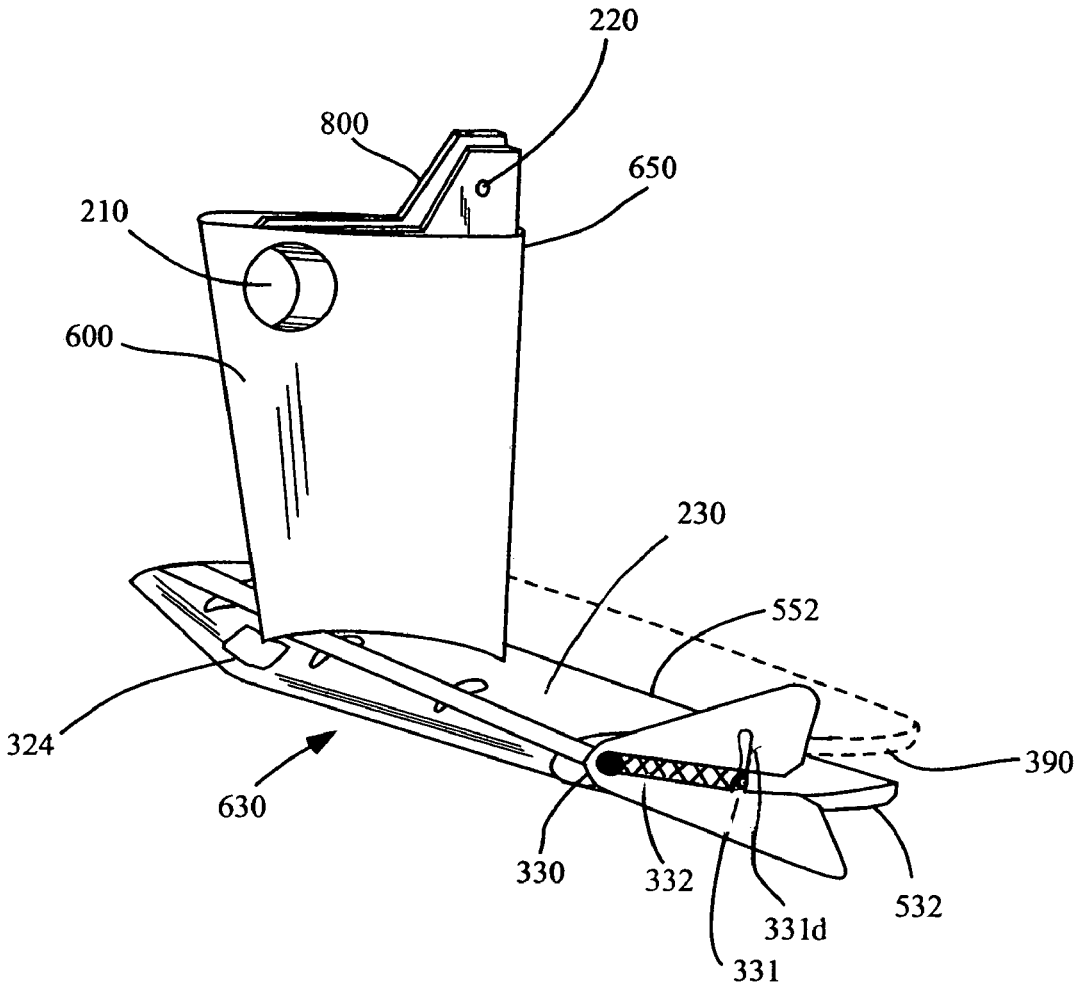
FIG. 6 is a side view of an alternate embodiment of the stabilization hydrofoil with a mechanical split-flap positioning in view of the wedge designed split flap.

Now referring to FIG. 6; as shown FIG. 6 is a close up view of a fourth embodiment of the hydrofoil 650.

The hydrofoil 650 is shaped the same and works as is described in the single foil embodiment, both passively and or with active hydraulic control.

Except now, a split flap 390 is connected to the horizontal foil 630. The split flap wedge is connected via a tie rod 330, arm assembly 332, and mounts 320 as before on each side of the horizontal foil 630.

A pivot arm 332 is connected to the split flap 390. The pivot 332 exists to change the position of the flap. A flexible joint with stops 331 is used to allow for the proper angle which will maintain the split flap in a neutral position.

During periods of high speed operation, hydrodynamic forces pull the split flap 390 down. This decreases the lift generated by the foil and flap assembly, since there is less surface area to generate lift. This split flap differs in design in that the wedge shape 552 at the leading edge of the split flap 390 produces high enough pressure at the upper surface of the split flap 390 to hold it in the down position away from the lower NACA foil 230. It is then locked in position until hydrostatic forces release the locking mechanism 331*d* at low speed. A manual cable (not shown) may also release the hydrostatic locking mechanism.

For operator reference only, a position feed back sensor 324 is installed and electrically connected to provide a position reading at the operator panel.

As in other embodiments, a limit stop prevents the tie rod member from rotating past a desired set point. This set point is adjustable via an externally accessible set screw device. In addition to providing the result described above, the split flap works in a completely different way when the stabilizer is controlling motion while the boat is at rest.

At rest, this split flap is used to increase and decrease cupping action at low to zero speed operation. Cupping action is increased when the horizontal foil moves in its downward stroke and cupping action is decreased in its upward stroke. This cupping action is similar to a swimmer using cupped hands to maintain body orientation while treading water. During active stabilization at low to zero speed, one horizontal foil is directed downward on the side of the boat which is rolling away from its upright attitude. At the same time, the foil on the other side of the boat is moving up. The split flap separates and moves downward. This decreases cupping action, so water will spill away from the horizontal foil 230 more easily.

Figure 6A:
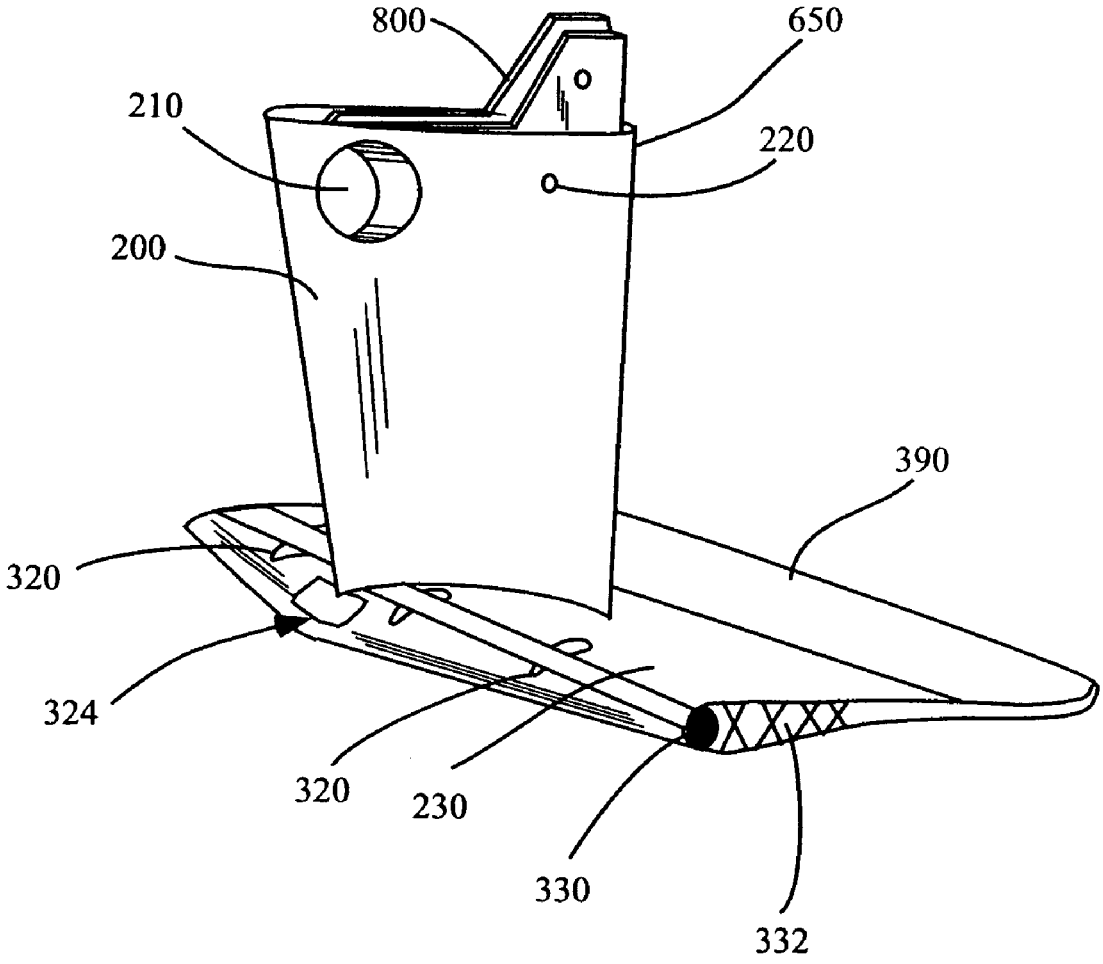
FIG. 6A is a side view of an alternate embodiment of the stabilization hydrofoil with mechanical split-flap shown in the up (nested) position.

FIG. 6A depicts the split wedge flap configured in the up position.

Torque Plate Configuration

Figures 7, 8:
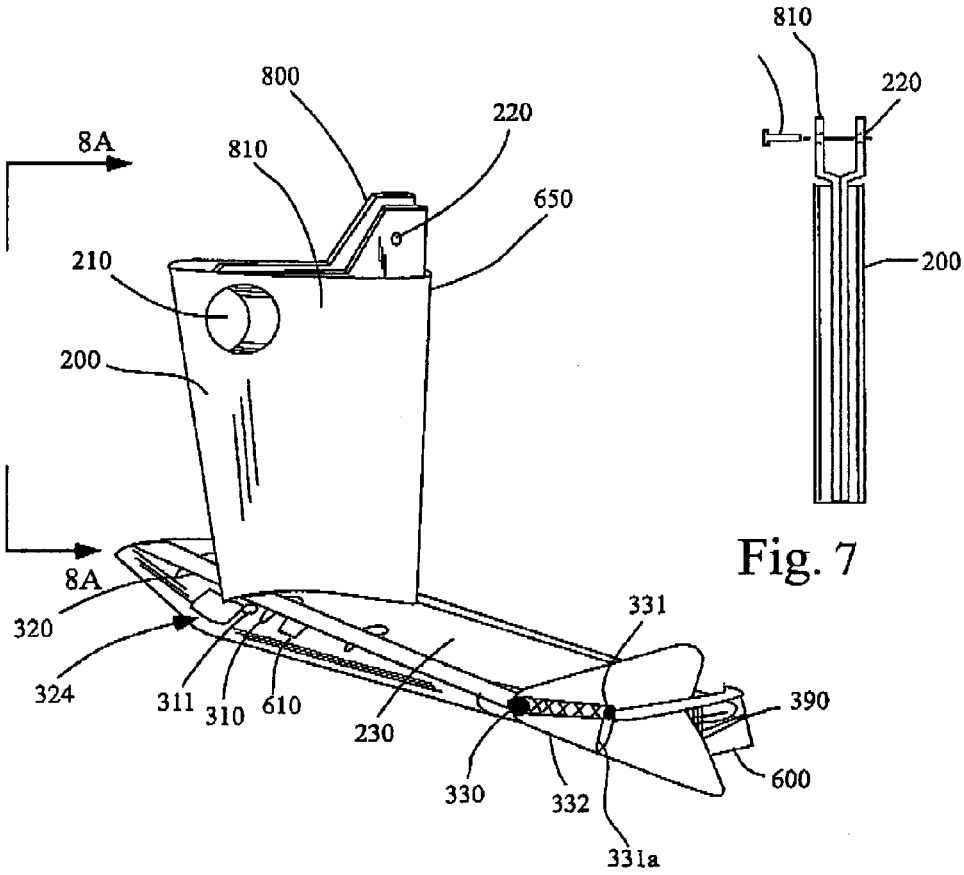
FIG. 7 is a side view of the of the internal torque plates.
FIG. 8 shows the detail of the internal torque plates.

Now referring to FIGS. 7 and 8. As shown in FIG. 8 a torque plate assembly 810 consists of a hole 210 for a steel and composite tube to be attached. Two holes 220 are provided to facilitate the attachment of the hydraulic cylinder rod end.

The two torque plates 810 where the hydraulic cylinder attaches at hole 220, merge at the bend-line to form a single vertical interior support.

The foil shell surrounds the torque plate to form the NACA shape of the vertical foil 200.

The torque plate 810 now features an extended area forward of hole 220 to act as a position-stop against the hydraulic cylinder body. This prevents the hydrofoil from moving at a greater position than needed for yacht stabilization. It provides for a safety stop to prevent the hydraulic cylinder from retracting to a position which would cause the hydrofoil to induce extreme roll. A pad area 820 now exists to provide a safety stop against the hull mounting bracket 160. It provides for a safety stop, to prevent the hydraulic cylinder from extending to a position which would cause the hydrofoil to induce extreme roll.

Reinforcement (not shown) is added around the tube installed in hole 210 to improve durability.

Figure 9:
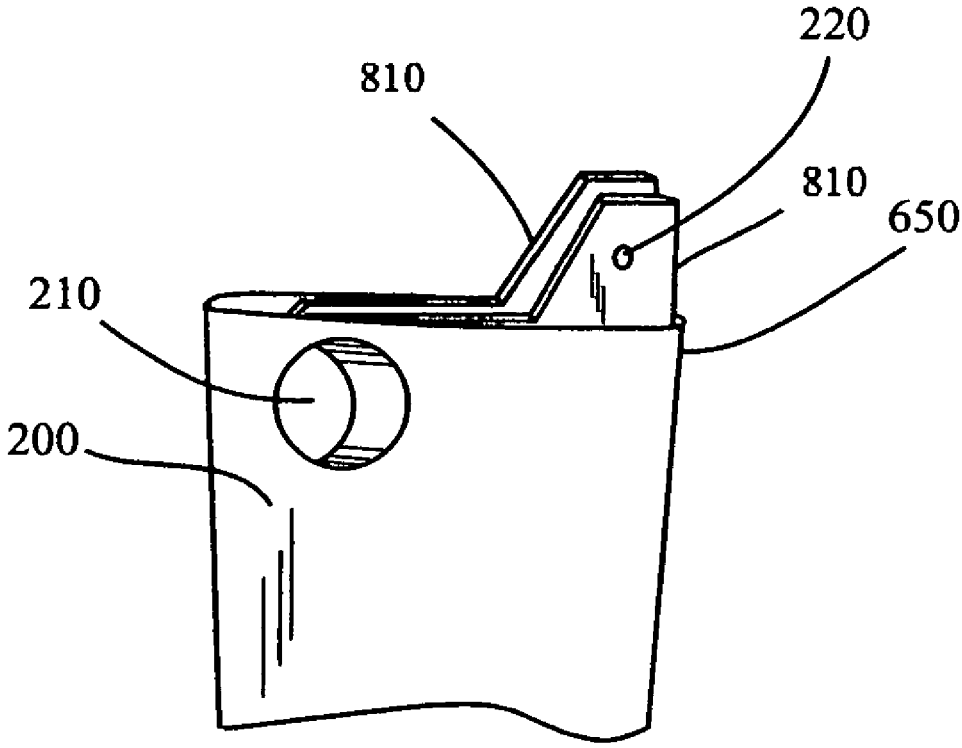
FIG. 9 shows close up detail of the torque plates exterior.

Now referring to FIG. 9. FIG. 9 shows a close up view of the external area of the torque plate 810.

Control System Implementation

Figure 10:
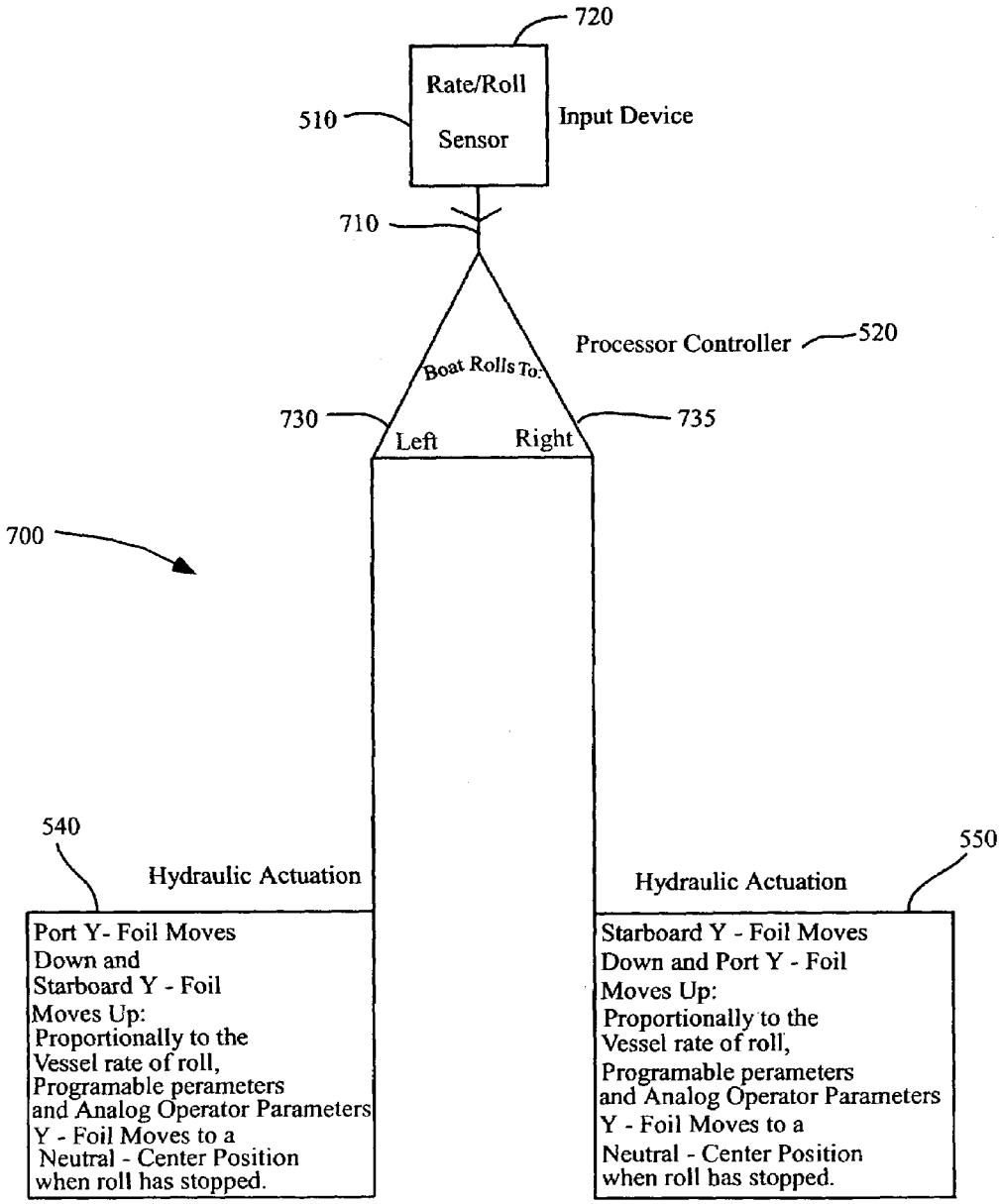
FIG. 10 is a flow diagram of the actuator system connected to the hydrofoils.

Now referring to FIG. 10, a decision tree 700 is shown that indicates how the stabilization control system operates. The process of active boat stabilization is essentially the same for each type of hydrofoil 150, 450, 550 and 650.

The rate of roll sensor reading 710, from the motion sensor 120, indicates the direction and rate of vessel roll.

If the vessel rolls to the left 730, the actuator on the port hydrofoil 150,450, 550, and 650 is pushed down (increasing lift) and the actuator on the starboard side hydrofoil 150,450, 550 and 650 is pulled up (decreasing lift). This movement is proportional to the electrical signal value from the roll rate sensor 710 which is proportional to the vessel rate of roll. Operator inputs and computer programming parameter values are available to attenuate this action.

If the vessel rolls to the right 735, the actuator pushes the starboard side hydrofoil 150, 550, 650, down (increasing lift) and pulls the port side hydrofoil 150, 550, 650 up (decreasing lift). This movement is proportional to the electrical signal value of the roll rate sensor 710 which is proportional to the vessel rate of roll. Operator inputs and computer programming parameter values are available to attenuate this action.

When roll has been stopped, both actuators move the hydrofoils to their neutral position. These actions work the same way regardless of vessel speed. However, the angle of the horizontal foil 230 will be greater at slower speeds and at rest.

I claim:

1. A yacht stabilizer comprising:

a vessel;

a stabilization system, the stabilization system comprising a first strut, the first strut movably attached to the transom of the vessel;

a first hydrofoil, the first hydrofoil perpendicularly attached to said first strut;

wherein the first hydrofoil further comprises a second strut, the second strut having a first end and a second end; a mini foil, said mini foil having a top part and a bottom part; the first end of the second strut connected to the bottom part of the first hydrofoil and the bottom end of the second strut is perpendicularly attached to the top part of the mini foil; and an active stabilization system, the active stabilization system comprising:

a strut hole;

an actuator;

a vessel actuator mount;

a motion sensor, a torque plate, and a stabilization computer, wherein the actuator is connected between the torque plate through the strut hole and to the vessel actuator mount, the actuator is electrically connected to the stabilization computer, and the motion sensor is connected to the stabilization computer, whereby when the motion sensor senses a change of direction, the stabilization computer energizes the actuator to counteract the change of direction.

2. A method for improving yacht stabilization consisting of providing a means for measuring the displacement of a yacht from the level position providing a means for resisting the change from the level position wherein the means for resisting change is an actuator coupled with a hydrofoil and mounting the actuator to the transom of the yacht and the measuring and change resisting is performed while the hull of the yacht is resting in the water.

3. The method of claim 2 wherein the step of providing means for resisting change further comprises a minifoil, a minifoil fixably attached to the base of the hydrofoil.

4. A hydrofoil comprising:

a first strut, a hydrofoil, the hydrofoil perpendicularly attached to the first strut;

a split flap, the split flap having a front end and a rear end, the split flap movably connected to the front of the hydrofoil, wherein the split flap further comprises a top part and a bottom part, a second strut, the second strut having a top part and a bottom part, and a mini foil, wherein the bottom part of the second strut is perpendicularly mounted to the mini foil and the top part of the second strut is mounted to the base of the bottom part of the split flap.

* * * * *